US010302291B2

(12) United States Patent
Parsons

(10) Patent No.: US 10,302,291 B2
(45) Date of Patent: May 28, 2019

(54) SETTABLE MULTI-LEVEL FLASHLIGHT

(71) Applicant: Armament Systems and Procedures, Inc., Appleton, WI (US)

(72) Inventor: Kevin Parsons, Appleton, WI (US)

(73) Assignee: Armament Systems and Procedures, Inc., Appleton, WI (US)

( * ) Notice: Subject to any disclaimer, the term of this patent is extended or adjusted under 35 U.S.C. 154(b) by 0 days.

(21) Appl. No.: 15/648,691

(22) Filed: Jul. 13, 2017

(65) Prior Publication Data

US 2019/0017689 A1 Jan. 17, 2019

(51) Int. Cl.

| | |
|---|---|
| ***F21V 23/04*** | (2006.01) |
| ***F21V 17/02*** | (2006.01) |
| ***F21V 21/088*** | (2006.01) |
| ***F21L 4/08*** | (2006.01) |
| ***F21V 21/40*** | (2006.01) |
| ***F21V 17/12*** | (2006.01) |
| *F21Y 115/10* | (2016.01) |

(52) U.S. Cl.

CPC ..... *F21V 23/0421* (2013.01); *F21L 4/08* (2013.01); *F21V 17/02* (2013.01); *F21V 17/12* (2013.01); *F21V 21/0885* (2013.01); *F21V 21/406* (2013.01); *F21V 23/0407* (2013.01); *F21V 23/0428* (2013.01); *F21Y 2115/10* (2016.08)

(58) Field of Classification Search

CPC .. F21V 23/0421; F21V 23/0407; F21V 17/02; F21V 23/0428

USPC ..... 362/183, 187, 188, 202, 205, 206

See application file for complete search history.

(56) References Cited

U.S. PATENT DOCUMENTS

| | | | | |
|---|---|---|---|---|
| 6,294,746 | B1 * | 9/2001 | Yee | H01H 19/10 200/11 R |
| 6,513,947 | B1 * | 2/2003 | Huang | F21V 23/0421 362/206 |
| 2004/0190286 | A1 * | 9/2004 | Chapman | F21L 4/027 362/171 |
| 2009/0185368 | A1 * | 7/2009 | Holmes | F21L 4/027 362/184 |
| 2010/0277295 | A1 * | 11/2010 | Matthews | F21L 4/005 340/332 |
| 2011/0169419 | A1 * | 7/2011 | Matthews | H05B 33/0842 315/292 |
| 2012/0146552 | A1 * | 6/2012 | West | H05B 33/0854 315/362 |
| 2012/0176780 | A1 * | 7/2012 | Gross | F21L 4/027 362/184 |
| 2012/0224358 | A1 * | 9/2012 | Noble | F21L 4/027 362/158 |
| 2014/0092590 | A1 * | 4/2014 | Parker | F21L 4/02 362/184 |

OTHER PUBLICATIONS

"Pic 10 (L) F 320/322 6/8-Pin Flash-Based, 8-Bit Microcontrollers" (Microchip Technology Inc. 2015).

* cited by examiner

*Primary Examiner* — Christopher M Raabe

(74) *Attorney, Agent, or Firm* — Hahn Loeser & Parks LLP

(57) ABSTRACT

A flashlight with settable multi-levels of light that can be emitted.

19 Claims, 6 Drawing Sheets

| CHARGE CYCLE STATE | STAT1 | STAT2 | PG |
|---|---|---|---|
| Shutdown | Hi-Z | Hi-Z | Hi-Z |
| Standby | Hi-Z | Hi-Z | L |
| Charge in Progress | L | Hi-Z | L |
| Charge Complete (EOC) | Hi-Z | L | L |
| Temperature Fault | Hi-Z | Hi-Z | L |
| Timer Fault | Hi-Z | Hi-Z | L |
| System Test Mode | L | L | L |

SETTABLE MULTI-LEVEL FLASHLIGHT

This application relates to a flashlight with settable multi-levels of light that can be emitted.

BRIEF DESCRIPTION OF THE DRAWINGS

The following drawings illustrate the concepts of the present invention. Illustrations of an exemplary device are not necessarily drawn to scale.

DETAILED DESCRIPTION

Figure 1:
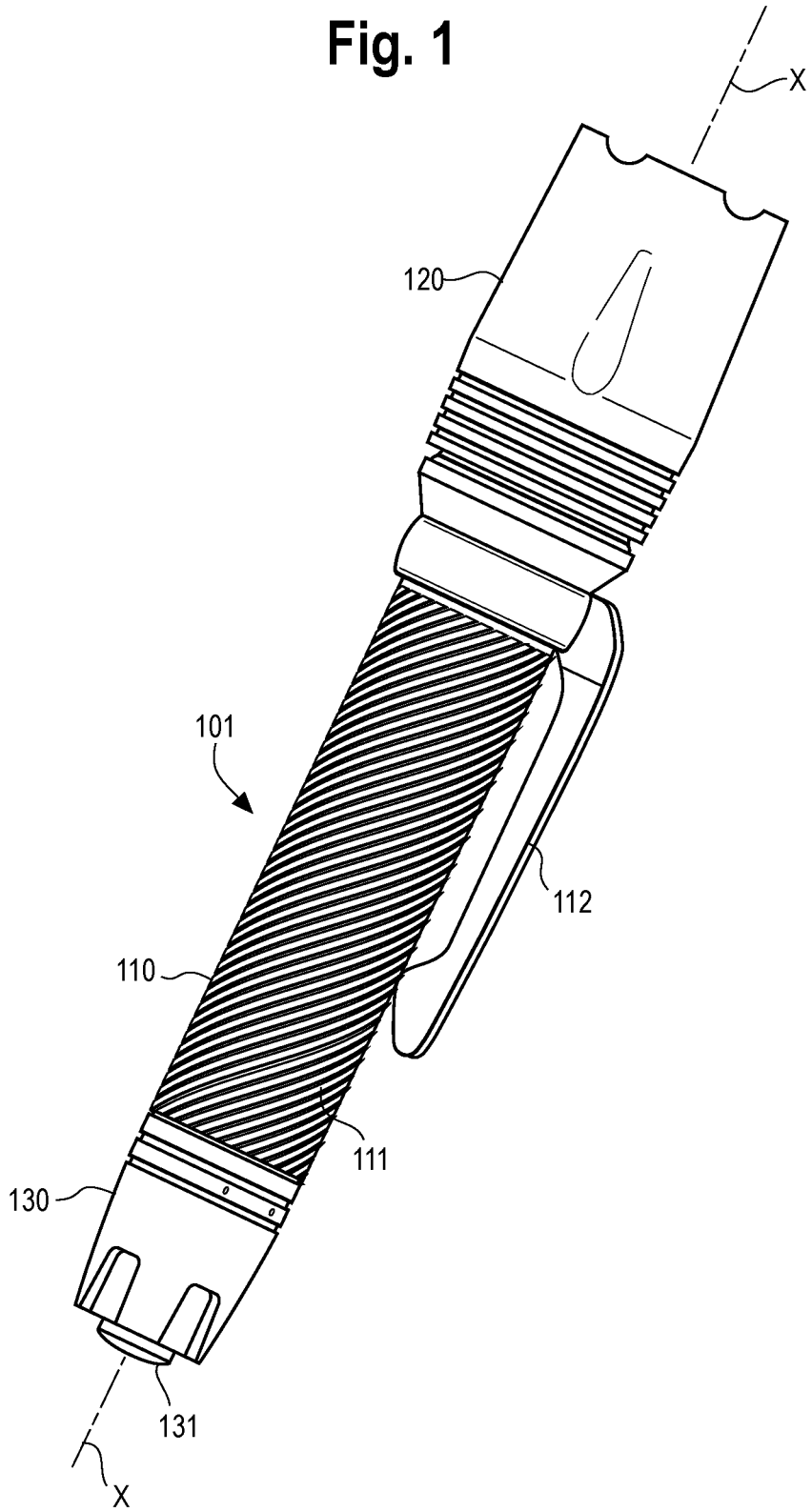
FIG. 1 is a perspective view of an embodiment of the flashlight with settable multi-levels of light.

While the embodiments described can take many different forms, specific embodiments illustrated in the drawings will be described with the understanding that the present disclosure is to be considered an exemplification of the principles of the invention, and is not intended to limit the invention to a specific embodiment illustrated.

Figure 3:
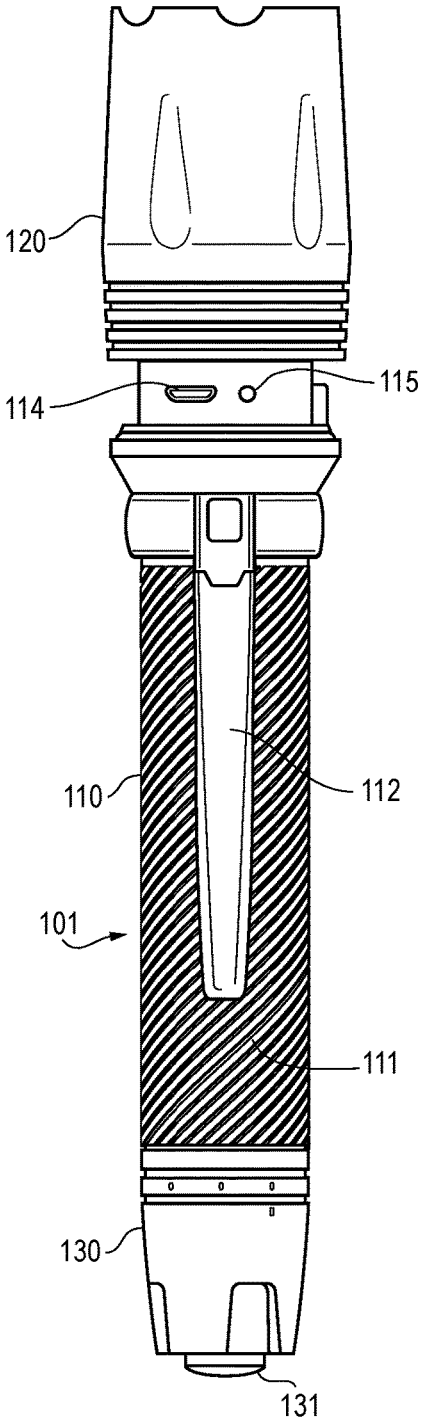
FIG. 3 is a side view of the embodiment of FIG. 1, rotated 90° from the view of FIG. 2 and with the bezel translated longitudinally in a direction away from the housing.
Figure 4:
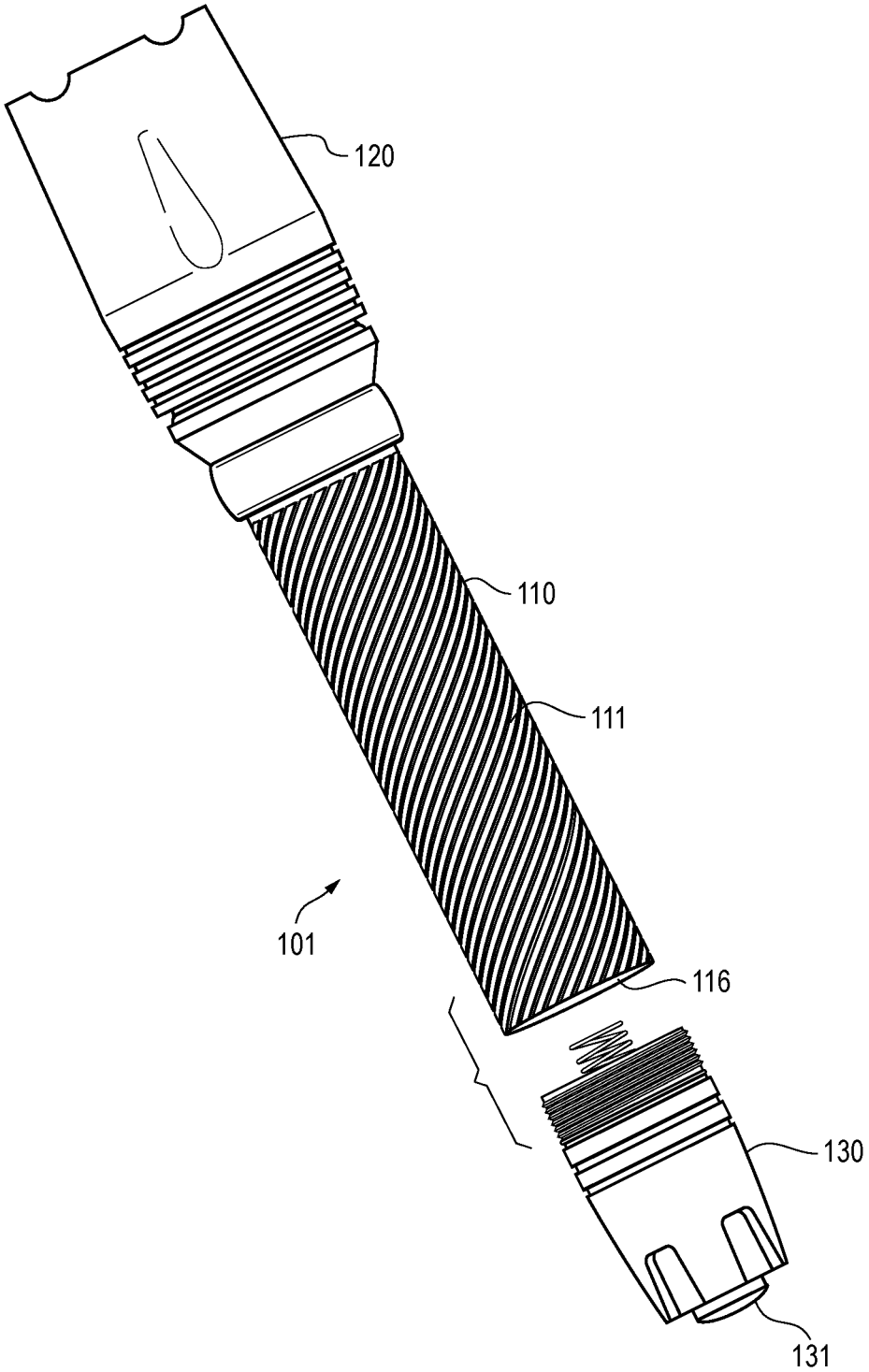
FIG. 4 is a perspective view of the embodiment of FIG. 1, with the rear button assembly disengaged from the housing.
Figure 5:
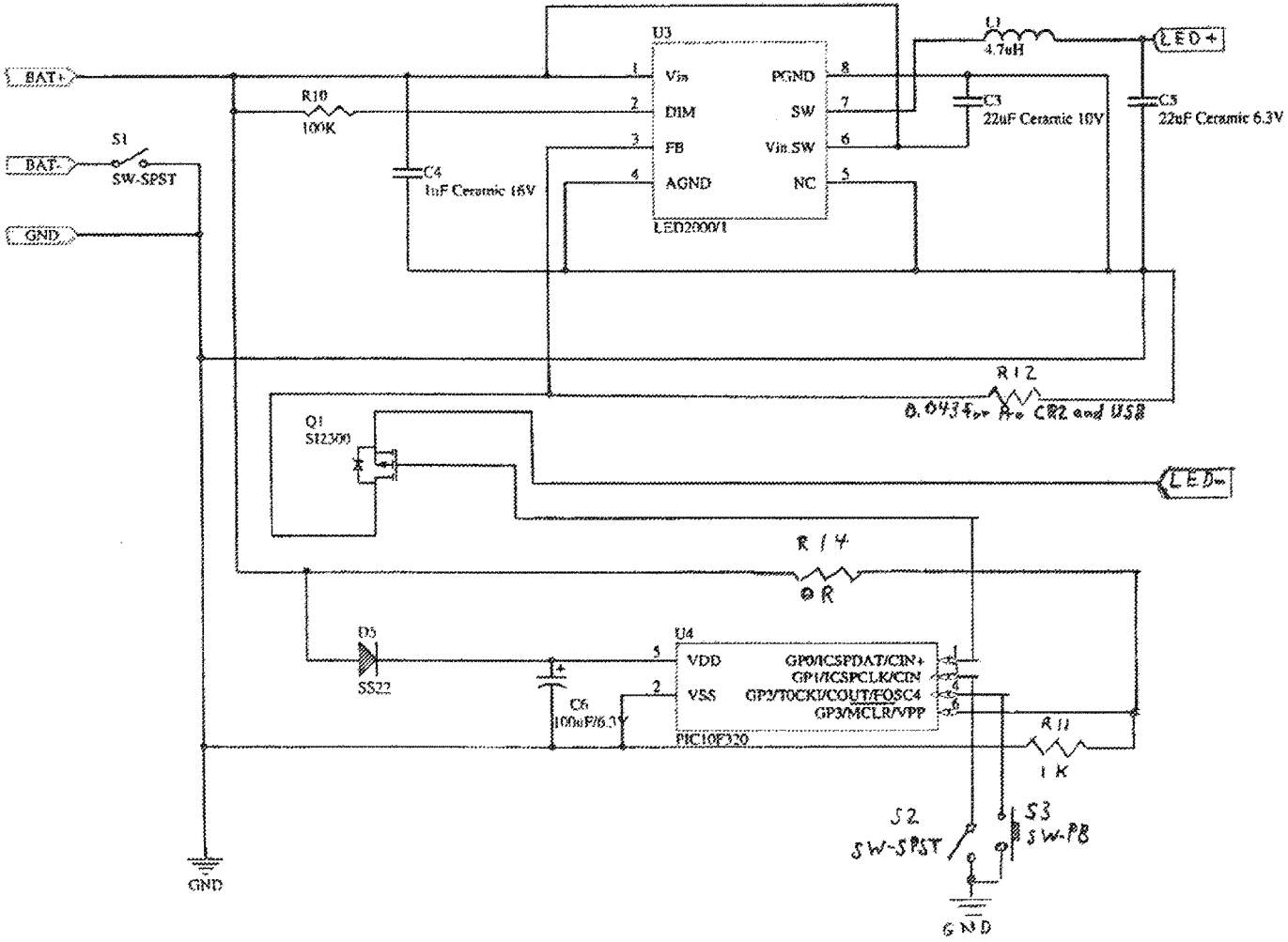
FIG. 5 is an electrical schematic of the LED driver circuit of the embodiment of FIG. 1.
Figure 6A:
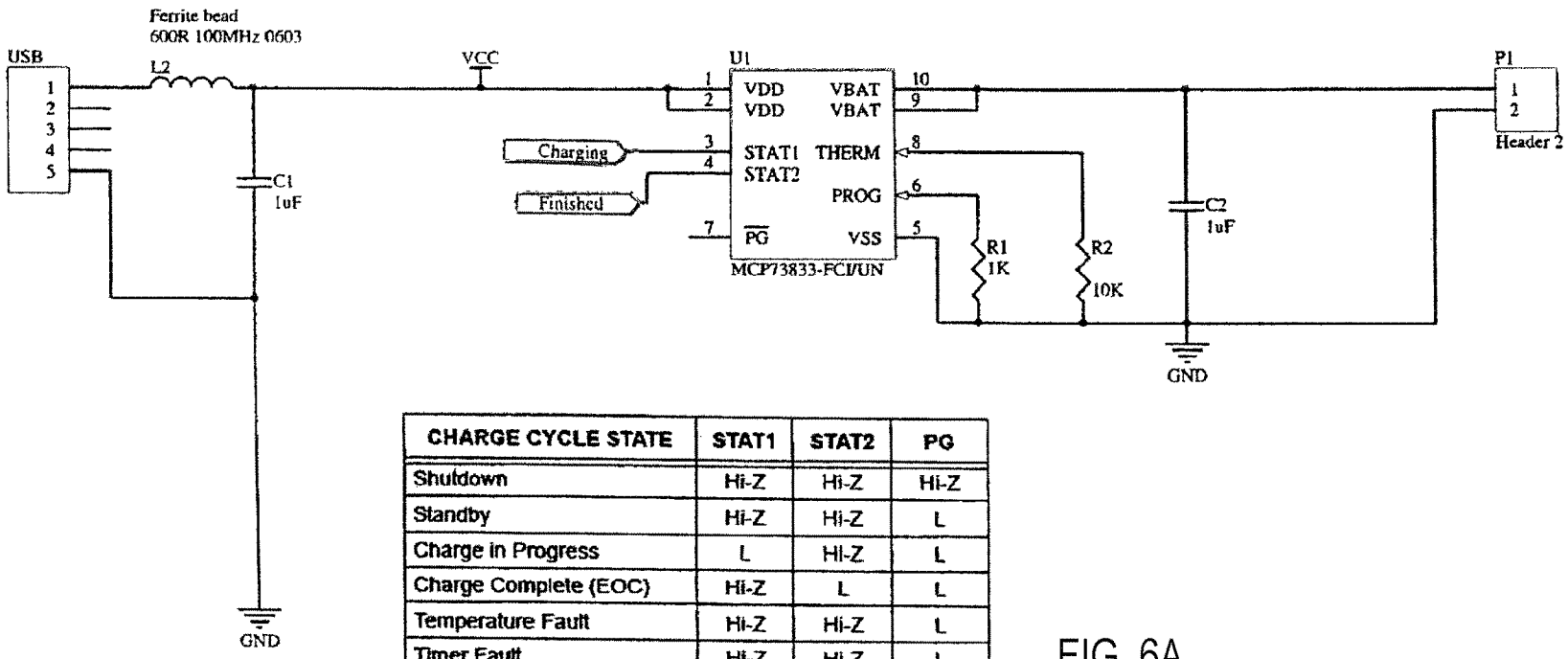
FIGS. 6A and 6B are an electrical schematic of the charging circuit of the embodiment of FIG. 1.
Figure 6B:
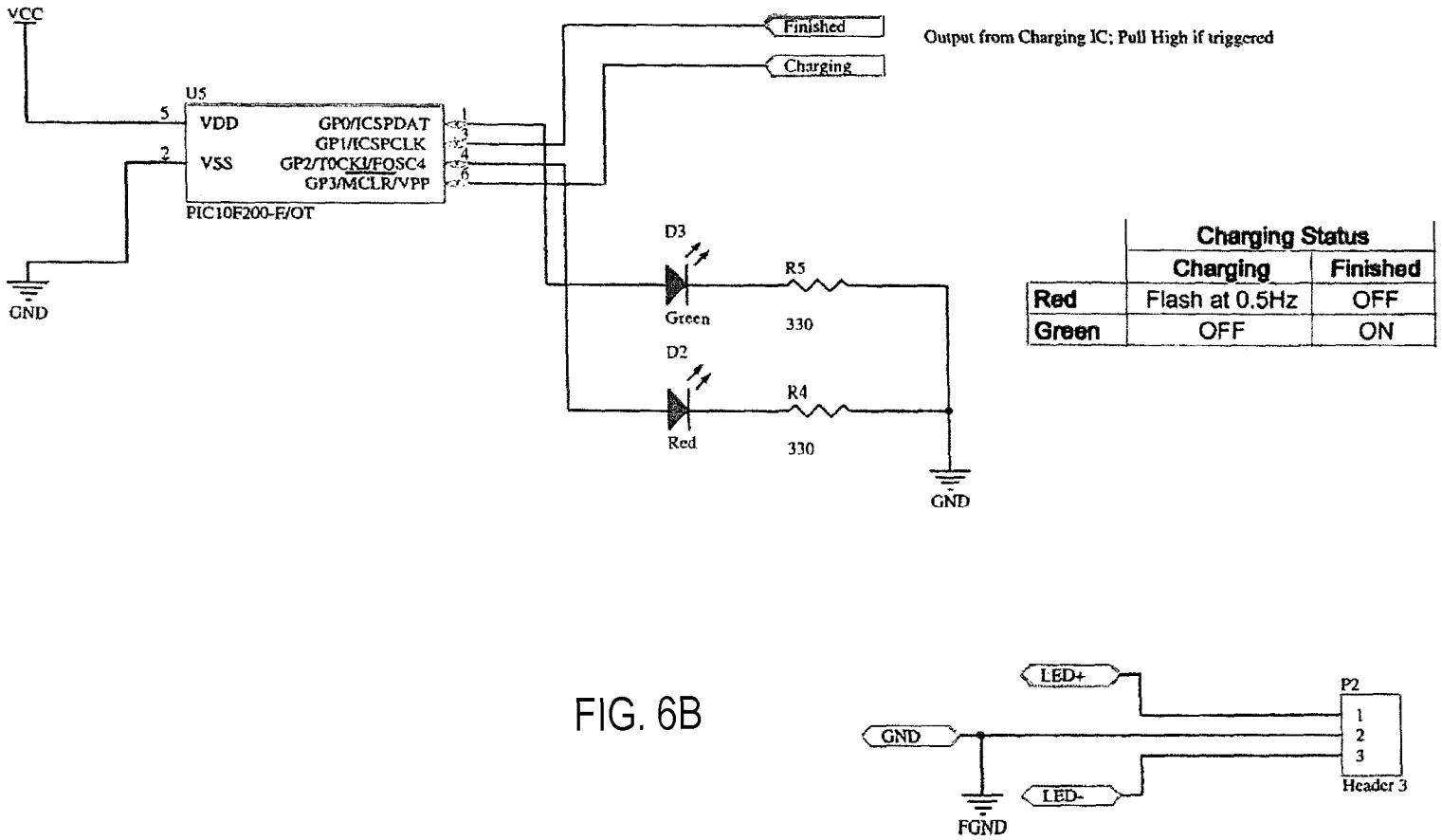

FIGS. 1-4 illustrate, respectively, a perspective view, side views rotated 90° from each other and with a bezel translated longitudinally in a direction away from a housing, and a perspective view with a rear button assembly disengaged from the housing, of an exemplary embodiment of a flashlight with settable multi-levels of light. FIG. 5 is an exemplary electrical schematic of an LED driver circuit of the embodiment of FIG. 1, and FIGS. 6A and 6B are an exemplary electrical schematic of a charging circuit of the embodiment of FIG. 1.

The exemplary flashlight 101 illustrated in FIGS. 1-4 comprises a cylindrical housing 110 having a longitudinal axis "x" and front and rear ends, a bezel 120 adjoining the front end of the housing, and a rear button assembly 130 adjoining the rear end of the housing.

In some embodiments, the housing 110 comprises an outer gripping surface that comprises a spiral groove 111. The spiral groove 111 makes it less likely that the flashlight 101 will slip when being held, but also is less likely than a knurled surface, for example, to abrade a user's clothing.

In some embodiments, the flashlight 101 comprises a clip 112 that is appended to the outer surface of the housing 110 for releasable attachment of the flashlight 101 to a user's person.

The bezel 120 comprises a light emitting element (not shown), such as at least one light emitting diode (LED). In some embodiments, the bezel 120 is rotatable about the longitudinal axis "x" over a limited range of rotation. When the bezel 120 is rotated in a first direction, the bezel 120 also moves longitudinally away from the housing 110 along the longitudinal axis "x." When the bezel 120 is rotated in an opposite second direction, the bezel 120 also moves longitudinally toward the housing 110 along the longitudinal axis.

Figure 2:
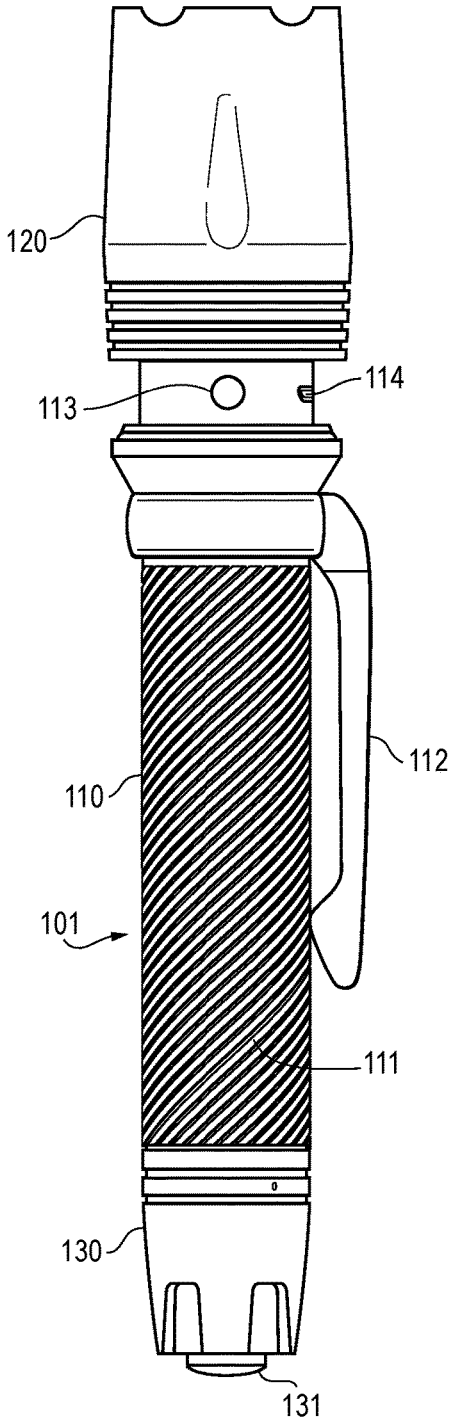
FIG. 2 is a side view of the embodiment of FIG. 1, with the bezel translated longitudinally in a direction away from the housing.

As best seen in FIGS. 2 and 3, when the bezel 120 is rotated in the first direction and moves longitudinally away from the housing 110, an alternative light setting selection button 113 and a universal serial bus (USB) input port 114 are exposed at the first end of the housing 110.

In some embodiments, the rear button assembly 130 adjoins the rear end of the housing 110 by threading engagement. The housing 110 comprises a battery chamber 116, and a battery (not shown) can be inserted into, or removed from, the battery chamber 116 when the rear button assembly 130 is disengaged from the rear end of the housing 110, as seen in FIG. 4.

In some embodiments, the battery can be rechargeable, and can be recharged when power is supplied through the USB input port 114. For example, power can be supplied from a computer or from wall power with appropriate rectification. In some embodiments, there is a charging status indicator 115. For example, the charging status indicator 115 can flash red while the battery is charging, and can emit a steady green when the battery is fully charged until the power source is disconnected from the USB input port 114.

In some embodiments, the distal end of the bezel 120, the distal end of the rear button assembly 130, or both are tapered for easier insertion of the flashlight 101 into a user's pocket.

In some embodiments, the rear button assembly 130 comprises a rear button 131 that operates by being depressed in a direction of the longitudinal axis "x." Circuitry causes the light emitting element to emit a steady bright light if the rear button 131 is single-depressed, and causes the light emitting element to emit at a desired alternative light setting if the rear button 131 is double-depressed. In some embodiments, the circuitry allows the light emitting element to cycle through a plurality of available alternative light settings if the bezel 120 is rotated in the first direction, and allows a user to select the desired alternative light setting from among the plurality of available alternative light settings before the bezel 120 is rotated back in the second direction. Examples of available alternative light settings include a strobe light and steady lights having different respective levels of brightness, such as 5, 15, 45 and 80 lumens. Other examples include lights of different respective colors.

In some embodiments, the light emitting element automatically cycles through the plurality of available alternative light settings if the bezel 120 is rotated in the first direction. In some embodiments, the light emitting element cycles through the plurality of available alternative light settings after further user action if the bezel 120 is also rotated in the first direction. In some embodiments, light emitting element automatically cycles through the plurality of available alternative light settings if the bezel 120 is rotated in the first direction and the rear button 131 is maintained in a depressed state. In some embodiments, the light emitting element automatically cycles through the plurality of available alternative light settings if the bezel 120 is rotated in the first direction and the rear button 131 is depressed and released. In some embodiments, the circuitry causes the desired alternative light setting to be selected if the rear button 131 is maintained in a depressed state while the light emitting element is cycling through the plurality of available alternative light settings, and the rear button 131 is released when the light emitting element is emitting at the desired alternative light setting. In some embodiments, the circuitry causes the desired alternative light setting to be selected if the light emitting element is cycling through the plurality of available alternative light settings, and the rear button 131 is depressed and released when the light emitting element is emitting at the desired alternative light setting. In some embodiments, the circuitry causes the desired alternative light setting to advance sequentially to a next one of the plurality of available alternative light settings each time the alternative light setting selection button 113 is depressed and released before the bezel is rotated back in the second direction.

In some embodiments, at least a portion of the rear button assembly 130 is rotatable about the longitudinal axis "x" between three settings. In the first setting, the circuitry causes the light emitting element to continue to emit the steady bright light or at the desired alternative light setting after the rear button 131 is depressed and released, until the rear button 131 is depressed and released a second time. In the second setting, the rear button 131 cannot be depressed far enough for the circuitry to cause the light emitting element to emit any light. In the third setting, the circuitry causes the light emitting element to emit the steady bright light or at the desired alternative light setting only as long as the rear button 131 is maintained in a depressed state.

From the foregoing, it will be understood that numerous modifications and variations can be effectuated without departing from the true spirit and scope of the novel concepts of the present invention. It is to be understood that no limitation with respect to the specific embodiments illustrated and described is intended or should be inferred.

The invention claimed is:

1. A flashlight, comprising:

a cylindrical housing having a longitudinal axis and front and rear ends;

a bezel adjoining the front end of the housing, the bezel comprising a light emitting element, the bezel being rotatable about the longitudinal axis over a limited range of rotation, where rotation of the bezel in a first direction moves the bezel away from the housing along the longitudinal axis and rotation of the bezel in an opposite second direction moves the bezel toward the housing along the longitudinal axis;

a rear button assembly adjoining the rear end of the housing, the rear button assembly comprising a rear button that operates by being depressed in a direction of the longitudinal axis;

circuitry that is configured to allow the light emitting element to cycle through a plurality of available alternative light settings if the bezel is rotated in the first direction, and to allow a user to select a desired alternative light setting from among the plurality of available alternative light settings before the bezel is rotated back in the second direction; and when the bezel has been rotated back in the second direction, the circuitry causes the light emitting element to emit a steady bright light if the rear button is single-depressed, and causes the light emitting element to emit at the desired alternative light setting if the rear button is double-depressed;

wherein the plurality of available alternative light settings and configuration of the circuitry are predetermined by dedicated hardware and are not user-reprogrammable.

2. The flashlight of claim 1, wherein the light emitting element automatically cycles through the plurality of available alternative light settings if the bezel is rotated in the first direction.

3. The flashlight of claim 1, wherein the light emitting element cycles through the plurality of available alternative light settings after further user action if the bezel is also rotated in the first direction.

4. The flashlight of claim 1, wherein the light emitting element automatically cycles through the plurality of available alternative light settings if the bezel is rotated in the first direction and the rear button is maintained in a depressed state.

5. The flashlight of claim 1, wherein the light emitting element automatically cycles through the plurality of available alternative light settings if the bezel is rotated in the first direction and the rear button is depressed and released.

6. The flashlight of claim 1, wherein the circuitry causes the desired alternative light setting to be selected if the rear button is maintained in a depressed state while the light emitting element is cycling through the plurality of available alternative light settings, and the rear button is released when the light emitting element is emitting at the desired alternative light setting.

7. The flashlight of claim 1, wherein the circuitry causes the desired alternative light setting to be selected if the light emitting element is cycling through the plurality of available alternative light settings, and the rear button is depressed and released when the light emitting element is emitting at the desired alternative light setting.

8. The flashlight of claim 1, further comprising:

an alternative light setting selection button that is exposed at the first end of the housing when the bezel is rotated in the first direction; and wherein the circuitry causes the desired alternative light setting to advance sequentially to a next one of the plurality of available alternative light settings each time the alternative light setting selection button is depressed and released before the bezel is rotated back in the second direction.

9. The flashlight of claim 1, wherein the plurality of available alternative light settings comprises a strobe light and a plurality of steady lights having different respective levels of brightness.

10. The flashlight of claim 1, wherein the plurality of available alternative light settings comprises a plurality of lights of different respective colors.

11. The flashlight of claim 1, wherein at least a portion of the rear button assembly is rotatable about the longitudinal axis between first, second and third settings;

when the rear button assembly is in the first setting, the circuitry causes the light emitting element to continue to emit the steady bright light or at the desired alternative light setting after the rear button is depressed and released until the rear button is depressed and released a second time;

when the rear button assembly is in the second setting, the rear button cannot be depressed far enough for the circuitry to cause the light emitting element to emit any light; and when the rear button assembly is in the third setting, the circuitry causes the light emitting element to emit the steady bright light or at the desired alternative light setting only as long as the rear button is maintained in a depressed state.

12. The flashlight of claim 1, wherein a distal end of the bezel is tapered.

13. The flashlight of claim 1, wherein a distal end of the rear button assembly is tapered.

14. The flashlight of claim 1, the housing comprising an outer gripping surface that comprises a spiral groove.

15. The flashlight of claim 1, further comprising a clip that is appended to an outer surface of the housing for releasable attachment of the flashlight to the user's person.

16. The flashlight of claim 1, wherein the light emitting element comprises at least one light emitting diode.

17. The flashlight of claim 1, wherein the housing comprises a battery chamber; and the rear button assembly adjoins the rear end of the housing by threading engagement, and a battery can be inserted into or removed from the battery chamber when the rear button assembly is disengaged from the rear end of the housing.

18. The flashlight of claim 1, further comprising:

a universal serial bus (USB) input port that is exposed at the first end of the housing when the bezel is rotated in the first direction;

wherein the housing comprises a battery chamber into which a rechargeable battery can be inserted; and wherein the circuitry causes the battery to be recharged when power is supplied through the USB input port.

19. The flashlight of claim 18, further comprising a charging status indicator.

* * * * *